US007607968B2

(12) United States Patent
Kamphausen et al.

(10) Patent No.: US 7,607,968 B2
(45) Date of Patent: Oct. 27, 2009

(54) APPARATUS ON A FLAT CARD OR ROLLER CARD FOR GRINDING A FIBRE PROCESSING CLOTHING DISPOSED ON A ROTATING CYLINDER OR A CARD FLAT

(75) Inventors: Rolf Kamphausen, Mönchengladbach (DE); Achim Breuer, Aachen (DE)

(73) Assignee: Trüzschler GmbH & Co. KG, Möchengladbach (DE)

( * ) Notice: Subject to any disclaimer, the term of this patent is extended or adjusted under 35 U.S.C. 154(b) by 0 days.

(21) Appl. No.: 12/073,228

(22) Filed: Mar. 3, 2008

(65) Prior Publication Data

US 2008/0220695 A1 Sep. 11, 2008

(30) Foreign Application Priority Data

Mar. 9, 2007 (DE) ..... 10 2007 011 984

(51) Int. Cl.
*B24B 49/00* (2006.01)
*B24B 51/00* (2006.01)
*D01G 15/00* (2006.01)

(52) U.S. Cl. ..... 451/8; 19/104; 19/111; 451/184

(58) Field of Classification Search ..... 19/99, 19/100, 104, 105, 106 R, 108, 110, 111, 112, 19/113, 114; 73/587, 649, 658, 659; 451/5, 451/8, 10, 11, 131, 184
See application file for complete search history.

(56) References Cited

U.S. PATENT DOCUMENTS

| | | | | |
|---|---|---|---|---|
| 2,866,301 | A * | 12/1958 | Juvet et al. | 451/8 |
| 4,821,460 | A * | 4/1989 | Wegmann | 451/26 |
| 4,831,785 | A * | 5/1989 | Sigg | 451/1 |
| 5,797,788 | A | 8/1998 | Graf et al. | |
| 6,290,574 | B1 * | 9/2001 | Thyssen | 451/9 |
| 6,668,425 | B2 * | 12/2003 | Breuer et al. | 19/98 |
| 6,675,441 | B2 * | 1/2004 | Breuer | 19/98 |
| 7,016,799 | B2 * | 3/2006 | Dondi | 702/104 |

(Continued)

FOREIGN PATENT DOCUMENTS

DE 40 07 838 C2 9/1991

(Continued)

OTHER PUBLICATIONS

German Search Report dated Jan. 9, 2008 in DE 10 2007 011 984.6.

(Continued)

*Primary Examiner*—Timothy V Eley
(74) *Attorney, Agent, or Firm*—Venable LLP; Robert Kinberg; Steven J. Schwarz

(57) ABSTRACT

In an apparatus on a carding machine for grinding a fiber processing clothing on a roller or a card flat, grinding equipment includes at least one grinding element and an infeed device serving to position the grinding element against the clothing. To permit reliable detection and monitoring of the contact between the at least one grinding element and the clothing in a simple manner, a structure-borne noise sensor is associated with the grinding equipment and an electronic evaluator is capable of determining from the structure-borne noise the intensity of the contact between the at least one grinding element and the clothing.

25 Claims, 8 Drawing Sheets

U.S. PATENT DOCUMENTS

| | | | | |
|---|---|---|---|---|
| 7,056,189 | B2 * | 6/2006 | Yui et al. | 451/5 |
| 2003/0049993 | A1 * | 3/2003 | Fujii | 451/8 |
| 2005/0217380 | A1 * | 10/2005 | Nebelsiek | 73/587 |
| 2007/0266528 | A1 * | 11/2007 | Farber et al. | 19/98 |

FOREIGN PATENT DOCUMENTS

| | | | |
|---|---|---|---|
| DE | 40 30 176 | A1 | 3/1992 |
| DE | 41 06 053 | A1 | 9/1992 |
| DE | 196 26 879 | A1 | 1/1998 |
| DE | 198 43 587 | A1 | 4/1999 |
| DE | 10 2004 060 663 | A1 | 7/2006 |
| EP | 0 957 188 | A1 | 11/1999 |
| EP | 1 329 286 | A1 | 7/2003 |
| FR | 2 306 791 | | 11/1976 |
| GB | 423559 | | 2/1935 |

OTHER PUBLICATIONS

UK Intellectual Property Office Search Report, dated Apr. 30, 2008, issued in connection with counterpart British Application No. GB0804210.3.

* cited by examiner

APPARATUS ON A FLAT CARD OR ROLLER CARD FOR GRINDING A FIBRE PROCESSING CLOTHING DISPOSED ON A ROTATING CYLINDER OR A CARD FLAT

CROSS REFERENCE TO RELATED APPLICATION

This application claims priority from German Patent Application No. 10 2007 011 984.6 dated Mar. 9, 2007, the entire disclosure of which is incorporated herein by reference.

BACKGROUND OF THE INVENTION

The invention relates to an apparatus on a flat card or roller card for grinding a fibre processing clothing that is disposed on a rotating roller or a card flat.

It is known to provide an apparatus having grinding equipment with at least one grinding element and an infeed device serving to position the grinding element against the clothing, the degree of infeed being adjustable and detectable.

In practice, grinding of the cylinder or the card flat is carried out in accordance with the approximate guidelines of the machine supplier or clothing manufacturer. These guidelines constitute a compromise between the many clothings used. If one considers the card flat, a typical grinding instruction states: apply to flat to produce scratch contact and infeed 4/1000". By the same token, these instructions attempt to convey to the operator pointers for efficient grinding on the basis of criteria relating to flying sparks and grinding noise. The practical application of grinding cannot be specifically represented in this way. In addition, the specific state of the clothing can only be given inadequate consideration, and the untrained operator has great problems in identifying whether he is grinding correctly.

In the case of a known apparatus (EP 0 957 188 A), grinding is effected by slowing advancing a grinding cylinder using a micrometer screw, until a slight grinding noise is audible. Depending on the type of clothing wires, grinding sparks occur. Once the grinding noise or the grinding sparks occur uniformly over the entire length of the card flat bar and the clothings of the card flat bar, this is an indication that all clothing wires have been subjected to the action of the grinding equipment and have been sharpened. The disadvantage of this procedure is that detection of the degree of infeed and the grinding intensity (contact pressure) is effected purely visually, and this is moreover dependent on the experience of the person carrying out the adjustment. An optimum and reproducible grinding operation is not possible in this manner.

SUMMARY OF THE INVENTION

It is an aim of the invention to produce an apparatus of the kind described initially, which avoids or mitigates the said disadvantages and which in particular with a simple construction permits reliable detection and monitoring of the contact between the at least one grinding element and the fibre processing clothing, especially during infeed and during grinding (grinding intensity).

The invention provides an apparatus on a carding machine for grinding a fibre processing clothing that is arranged on a rotating roller or a card flat, having grinding equipment with at least one grinding element and an infeed device serving to position the grinding element against the clothing, wherein the apparatus further comprises a structure-borne noise sensor associated with the grinding equipment and an electronic evaluator for determining from the structure-borne noise the intensity of the contact between the at least one grinding element and the fibre processing clothing.

Because a structure-borne noise sensor especially a high-sensitivity structure-borne noise sensor, is in association with, preferably in contact with, the grinding equipment, the contact between the at least one grinding element and the fibre processing clothing can be successfully detected with a simple construction. In this way, monitoring and control of the grinding equipment are rendered possible. The structure-borne noise sensor is advantageously coupled only to one component, in which structure-borne acoustic vibrations occur, the effect being that these structure-borne acoustic vibrations also enter the structure-borne noise sensor, pass through it and the vibration can be detected by measuring techniques. During grinding, the grinding elements generate a transverse vibration in the clothing, which propagates throughout the grinding equipment. If the structure-borne noise sensor, for example, a piezo sensor, is secured to the grinding equipment traversed by vibrations, then the vibration also runs through this component. The vibration consequently deforms this component too, i.e. the vibration can be described with the piezo sensor. The piezo signal is changed also when there is a constant force on the clothing. An electrical filtering of the signal is necessary, because the vibrations from other areas of the machine affect the structure-borne noise measurement. Low-frequency vibrations of all moving parts are filtered out. The device is of simple construction, since the sensor, for example, piezo sensor merely requires to be placed on the component. Using the device according to the invention, a structure-borne noise sensor is used for metrological detection of the structure-borne acoustic vibrations that occur during grinding. The structure-borne noise intensity to be detected represents a measured variable, that correlates very well with the intensity of the grinding, i.e. substantial infeed (contact pressure) means a high grinding intensity and a high structure-borne noise signal. There is thus a signal to be detected, the structure-borne noise, which enables grinding to be represented specifically. By this means, compared with the known apparatus, the type of flying spark no longer has to be analysed in order to evaluate the quality of the grinding; on the contrary, the signal of the structure-borne noise sensor is used to ensure proper grinding, or even to control the grinding. A further advantage is that adherence to a certain level of the structure-borne noise signal produces an optimum grinding. In particular, inaccuracies based on solely visual monitoring of the infeed and grinding process are avoided.

In certain preferred embodiments, the sensitivity of the structure-borne noise sensor amounts to about 10 V/N to 50 V/N, for example, about 25 V/N to 35 V/N. Advantageously, the structure-borne noise sensor is capable of detecting vibrations in the range from about 2.5 kHz to 12.5 kHz. Advantageously, the evaluator is capable of filtering out frequencies outside the range from about 2.5 kHz to 12 kHz. For example, the valuator may be capable of filtering out low-frequency vibrations. For the purpose of determining which vibrations to filter, the evaluator may have a frequency analysis function (Fourier analysis). Advantageously, a high-pass filter is used. Preferably, a piezo-ceramic structure-borne noise sensor is associated and in touching contact with the grinding equipment. Advantagously, the structure-borne noise sensor is associated with a component of the grinding equipment. Advantageously, the structure-borne noise sensor is associated with a grinding element. The structure-borne noise sensor may be fixed to the component or grinding element by, for example, adhesion, by magnetic force, by a screw connection, or by positive locking connection. Advantagously, there is a direct structure-borne noise conduction between the component or grinding element and an adapter plate, for example, through a screw connection. Advantageously, a quick-release fastener is present, for example, by means of a positive-locking or force-fit connection.

In certain preferred embodiments, the structure-borne noise sensor signals are filtered such that no components of structure-borne acoustic vibrations of the spinning room preparatory machine that are caused by moving machine parts are present in the signal. Preferably, all structure-borne acoustic vibrations less than 2.5 kHz are filtered out of the structure-borne noise sensor signals. Preferably, exclusively the components of the structure-borne noise sensor signals that are caused by the grinding operation are used. Advantageously, the structure-borne noise sensor signals are evaluated by means of statistical evaluation methods (mean value, standard deviation, CV value). Advantageously, the structure-borne noise sensor signals are integrated. Advantageously, the structure-borne noise sensor signals are evaluated over time and in the frequency range by means of statistical evaluation methods. Advantageously, the structure-borne noise sensor signals are logarithmised to avoid over-valuation of the signal peaks. Advantageously, grinding intensity classes (amplitude; frequency) are formed in order to be able to evaluate the pulses in detail.

With certain preferred embodiments, using the grinding intensity information, clothing wear at each carding component can be evaluated and the setting can be reassessed.

In one embodiment, the structure-borne noise sensor is in the form of a portable unit that can be used on any machine. That enables the portable unit to be used to monitor grinding of components of two or more machines by transferring the unit from one machine to another.

Advantageously, the clothing state, for example, new or worn clothing, for example, of a clothing strip, can be determined using the structure-borne noise sensor. Advantageously, a portable structure-borne noise sensor unit together with evaluation comprises, for example, a display for the output of the grinding intensity, a start button to activate measurement and an LED for displaying the operating state.

In one embodiment, the signals of the structure-borne noise sensor are recordable throughout the entire grinding process. Advantageously, the high-frequency structure-borne acoustic vibrations that occur during grinding can be picked up with the structure-borne noise sensor. Advantageously, an acceleration sensor is associated with the grinding equipment.

In one embodiment, a contactlessly measuring structure-borne noise sensor is associated with the rotating and traversing grinding cylinder, for example, shaft, axle. In another embodiment, a touching structure-borne noise sensor is associated with, for example, fixed to, at least one bearing point of the grinding cylinder.

In one embodiment, the structure-borne acoustic vibration is conductable from the rotating and traversing grinding cylinder, for example, shaft, axle, to a fixed structure-borne noise sensor by means of leaf springs. Advantageously, from a flat that is being ground, the structure-borne acoustic vibrations are receivable by means of the structure-borne noise sensor. Advantageously, the structure-borne noise sensor emits grinding information in the form of a voltage value, which serves as a measure of the grinding intensity. Advantageously, the optimum grinding intensity lies within a working range, i.e. between a lower and an upper limit. Preferably, a level outside the optimum grinding intensity of the structure-borne noise sensor is linked with a warning of the control means. Advantageously, within the limits of a closed loop the infeed of the grinding cylinder is actively alterable in dependence on the structure-borne noise sensor signals. Advantageously, a grinding intensity is ascertainable for each flat and after completion of grinding the distribution of the grinding intensity is displayable. Advantageously, for each flat revolution an overall grinding intensity is ascertainable, which decreases with each revolution. Advantageously, the gradation in the overall grinding intensity is displayable. Advantageously, the gradation in the overall grinding intensity of the control is predeterminable. Advantageously, the gradation in the overall grinding intensity is automatically controllable. Advantageously, the flat is guidable in the grinding range such that the grinding intensity changes across the flat width. Advantageously, a predetermined grinding profile across the flat width can be stored for the flat in the control means. Advantageously, falling below and/or exceeding predetermined profile limits causes a warning to be given. Advantageously, the flat guidance in the grinding range is specifically alterable on the basis of the warning. Advantageously, the flat guidance in the grinding range is automatically alterable on the basis of the warning. Advantageously, the signal frequencies and amplitudes of the grinding equipment that occur with no grinding operation (idling) can be picked up by means of the structure-borne noise sensor. Advantageously, the signal frequencies and amplitudes with no grinding operation can be filtered out of the signal by means of signal band filtering or cross correlation. Advantageously, during the grinding process exclusively the vibrations that are generated by the grinding are recordable and evaluatable. In certain embodiments, the clothing is a wire hook clothing. In certain other embodiments, the clothing is an all-steel clothing (saw-tooth wire clothing). In certain embodiments, the clothing is disposed on a revolving flat. In certain other embodiments, the clothing is disposed on a stationary flat. In yet further embodiments, the clothing is on a roller, for example, the cylinder of a flat card or roller card, or the doffer of a flat card or roller card.

The grinding apparatus may include one or more grinding elements selected from a full grinding cylinder, a traversing grinding wheel, and multiple traversing grinding wheels. The guiding apparatus may comprise at least one grinding stone. In certain illustrative embodiments the grinding apparatus comprises a traversing grinding stone, for example, a plurality of oscillating (traversing) grinding stones may be present. In one advantageous embodiment, at least one grinding element performs a back and forth oscillating or traversing movement during the grinding process. Advantageously, at least one grinding element is movable during the grinding process in the direction of a traverse path running perpendicular to the contact pressure direction towards the clothing. Preferably, the traverse path runs parallel to the longitudinal axis of the flat or the roller.

The invention also provides an apparatus on a flat card or roller card for grinding a fibre processing clothing that is arranged on a rotating roller or a card flat, having grinding equipment with at least one grinding element and an infeed device serving to position the grinding element against the clothing, the degree of infeed and the grinding intensity being detectable, wherein a high-sensitivity structure-borne noise sensor is associated with the grinding equipment and an electronic evaluator is capable of determining from the structure-borne noise the intensity of the contact between the at least one grinding element and the fibre processing clothing.

DETAILED DESCRIPTION OF CERTAIN PREFERRED EMBODIMENTS

Figure 1:
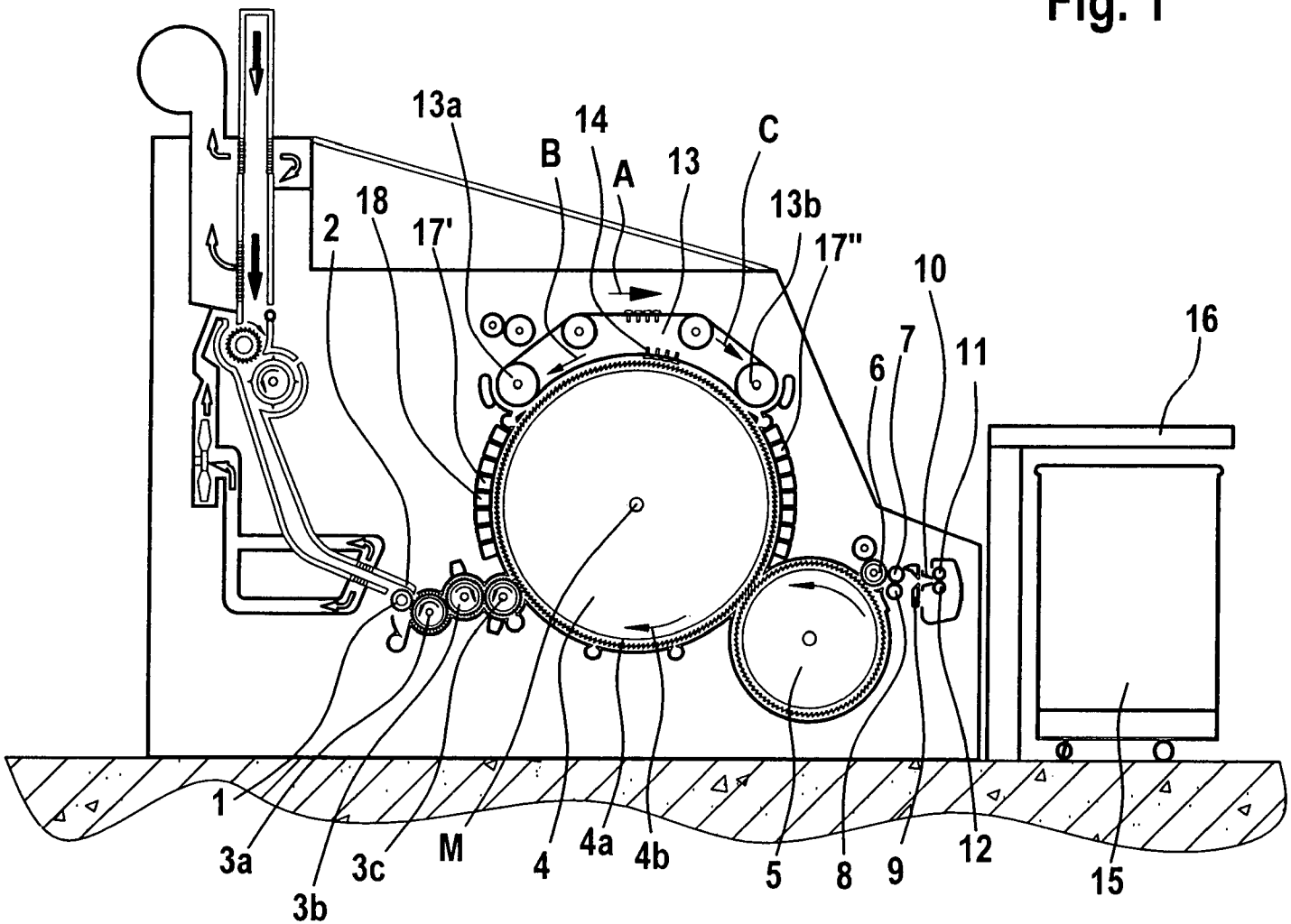
FIG. 1 is a schematic side view of a card with a first grinding apparatus according to the invention.

With reference to FIG. 1, a card, for example, a card TC 03 made by Trützschler GmbH & Co. K.G. of Mönchengladbach, Germany, has a feed roller 1, feed table 2, lickerins 3*a*, 3*b*, 3*c*, cylinder 4, doffer 5, stripping roller 6, squeezing rollers 7, 8, web-guide element 9, web funnel 10, take-off rollers 11, 12, revolving flat 13 with flat guide rollers 13*a*, 13*b* and flat bars 14, can 15 and can coiler 16. The directions of rotation of the rollers are shown by respective curved arrows. The letter M denotes the midpoint (axis) of the cylinder 4. The reference numeral 4*a* denotes the clothing and reference numeral 4*b* denotes the direction of rotation of the cylinder 4. The letter B denotes the direction of rotation of the revolving flat 13 in the carding position and the letter C denotes the return transport direction of the flat bars 14. Stationary covering or work elements, e.g. stationary carding elements $\mathbf{17}^{I}$ are arranged between the lickerin 3*c* and the rear flat guide roller 13*a* and stationary covering or work elements, e.g. stationary carding elements $\mathbf{17}^{II}$ are arranged between the front flat guide roller 13*b* and the doffer 5. The arrow A denotes the work direction. The curved arrows drawn in the rollers denote the direction of rotation of the rollers. The reference numeral 18 denotes grinding equipment according to the invention which in the embodiment of FIG. 1 is arranged for grinding of the clothing 4*a* of the cylinder 4.

Figure 2:
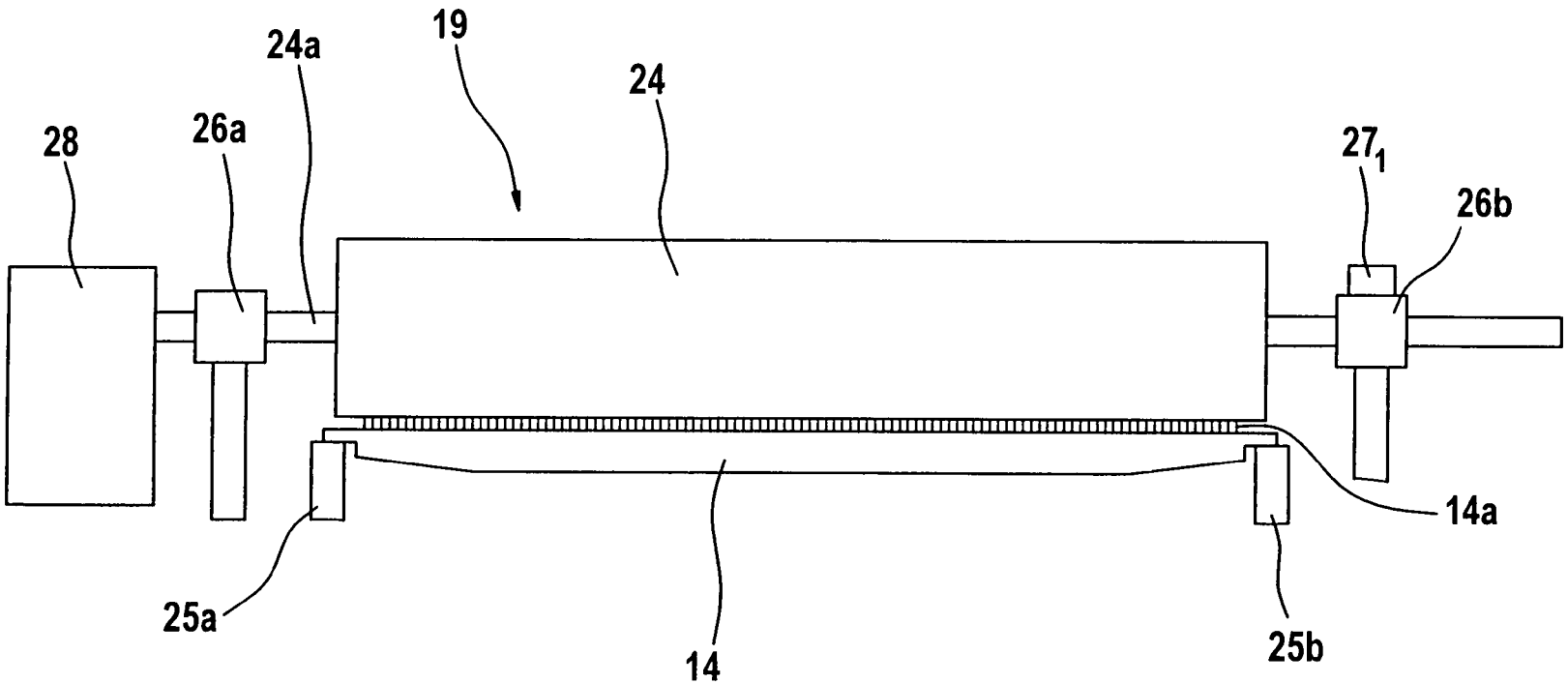
FIG. 2 is a front view of an embodiment for the grinding of card flat clothings outside the card.

In the embodiment of FIG. 2, the grinding apparatus 19 is suitable for grinding clothings 14*a* of a flat bar 14 outside the card (which card may be, for example, substantially as shown in FIG. 1). This equipment comprises a full grinding cylinder 24 having a movable carriage 25 with two fixing and guiding elements 25*a*, 25*b* for receiving one to four flat bars 14. During grinding, the carriage 25 guides the card flat bars continuously back and forth over the full grinding cylinder 24, until the clothings 14*a* have been ground down to an accurately set height. The axle 24*a* of the full grinding cylinder 24 is rotatably mounted in two stationary bearings 26*a*, 26*b*. A structure-borne noise sensor $\mathbf{27}_{I}$ is attached to one bearing 26*b*. The reference numeral 28 denotes a drive element, for example, a motor, for the full grinding cylinder 24.

Figure 3:
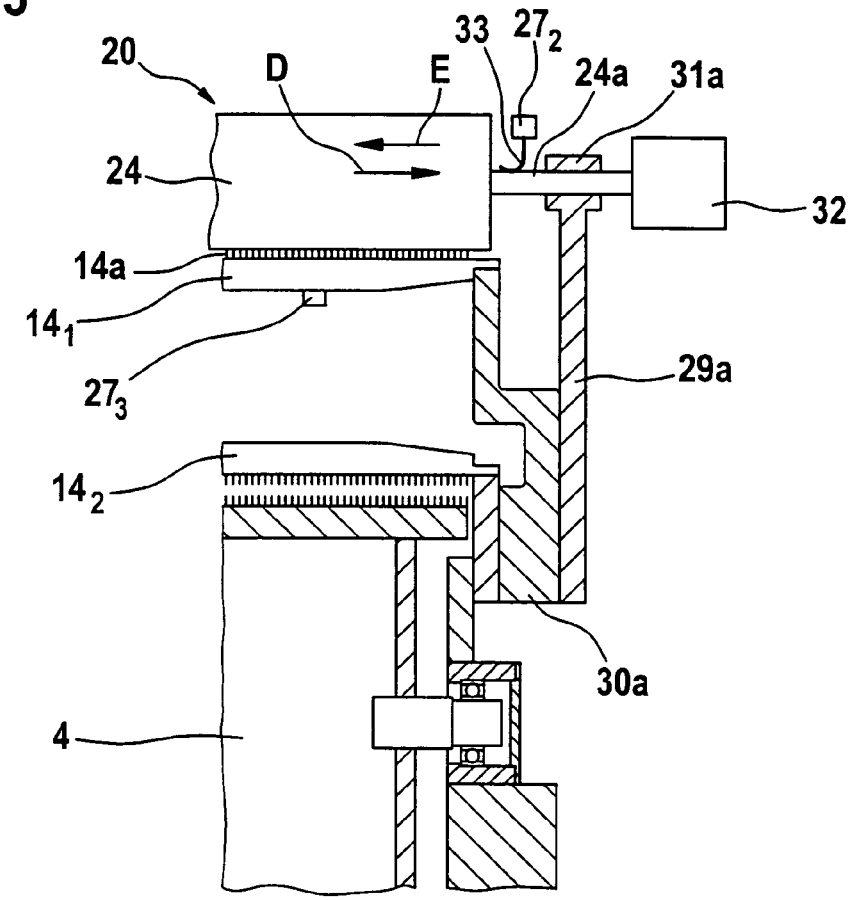
FIG. 3 is a partial front view of an embodiment for the grinding of card flat clothings on a card, having a full grinding cylinder.

In a further embodiment, shown in FIG. 3, a grinding apparatus 20 is suitable for grinding the clothing 14*a* of flat bars 14, whilst on the card. The grinding apparatus 20 has a full grinding cylinder 24, that is, the cylinder 24 extends across the full width of the flat bars 14. The revolving flat 13 is ground whilst the flat bars 14 are being returned in direction C (see FIG. 1). Grinding on the card can be carried out under normal production conditions, i.e. during the processing of fibre material, or even without fibre material. The full grinding cylinder 24 is a rotatable cylinder, which is fitted with a carborundum emery stone ($Al_2O_3$). The cylinder can be driven from the outside by a disc or by a motor housed in the cylinder. In that case, the tube is the rotor. Grinding cylinders extend with the cylinder fitted with emery across the entire width of the machine. The work elements of the card are thus always machined simultaneously across the full clothing width, which is very economical. The grinding equipment 20 is secured by means of two holding arms 29*a*, 29*b* (only 29*a* is shown) to the side panels 30*a*, 30*b* (only 30*a* is shown). During grinding, the full grinding roller 24 is moved axially back and forth (oscillating or traversing) in the direction of the arrows D and E. For that purpose, the axle 24*a* is axially movably mounted in two pivot bearings 31*a*, 31*b* (only 31*a* is shown). For the back and forth movement, a traversing device 32, for example, with a thrust crank, is associated with the axle 24*a*. A structure-borne noise sensor $\mathbf{27}_{2}$ is associated with the axle 24*a*, the structure-borne acoustic vibration being conducted from the rotating and traversing full grinding cylinder 24 by means of a leaf spring 33 to the stationary structure-borne noise sensor $\mathbf{27}_{2}$. A drive motor (not shown) (see FIG. 2) is provided for driving the full grinding roller 24. A structure-borne noise sensor $\mathbf{27}_{2}$ can be associated with the back of the flat bar 14.

Figure 4:
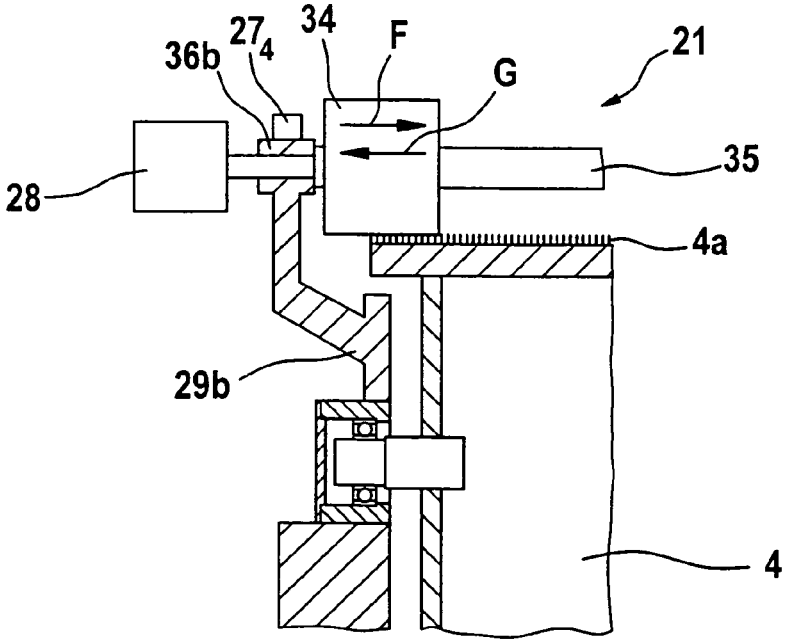
FIG. 4 is a partial front view of an embodiment for the grinding of roller clothings, having a traversing grinding wheel.

In the embodiment of FIG. 4, a grinding apparatus 21 has a traversing grinding wheel 34 for grinding roller clothings, for example, the clothing 4*a* of the cylinder 4, is present. In this case, the grinding head is a grinding stone approximately 90 mm wide, which is slidably arranged on a guide tube 35 and is displaced back and forth across the clothing 4*a* in the direction of the arrows F and G by a cross-threaded spindle inside the tube 35. In the process, the grinding head acts always only on a small portion of the total surface of the cylinder 4. The displacement back and forth can be effected by means of specially driven tension belts or the like instead of by cross-threaded spindles (not shown). The drive derives from a drive motor 28. The grinding equipment is mounted in stationary bearings 36*a*, 36*b* (only 36*b* is shown). A structure-borne noise sensor $\mathbf{27}_{4}$ is associated with the bearing 36*b*.

Figure 5A:
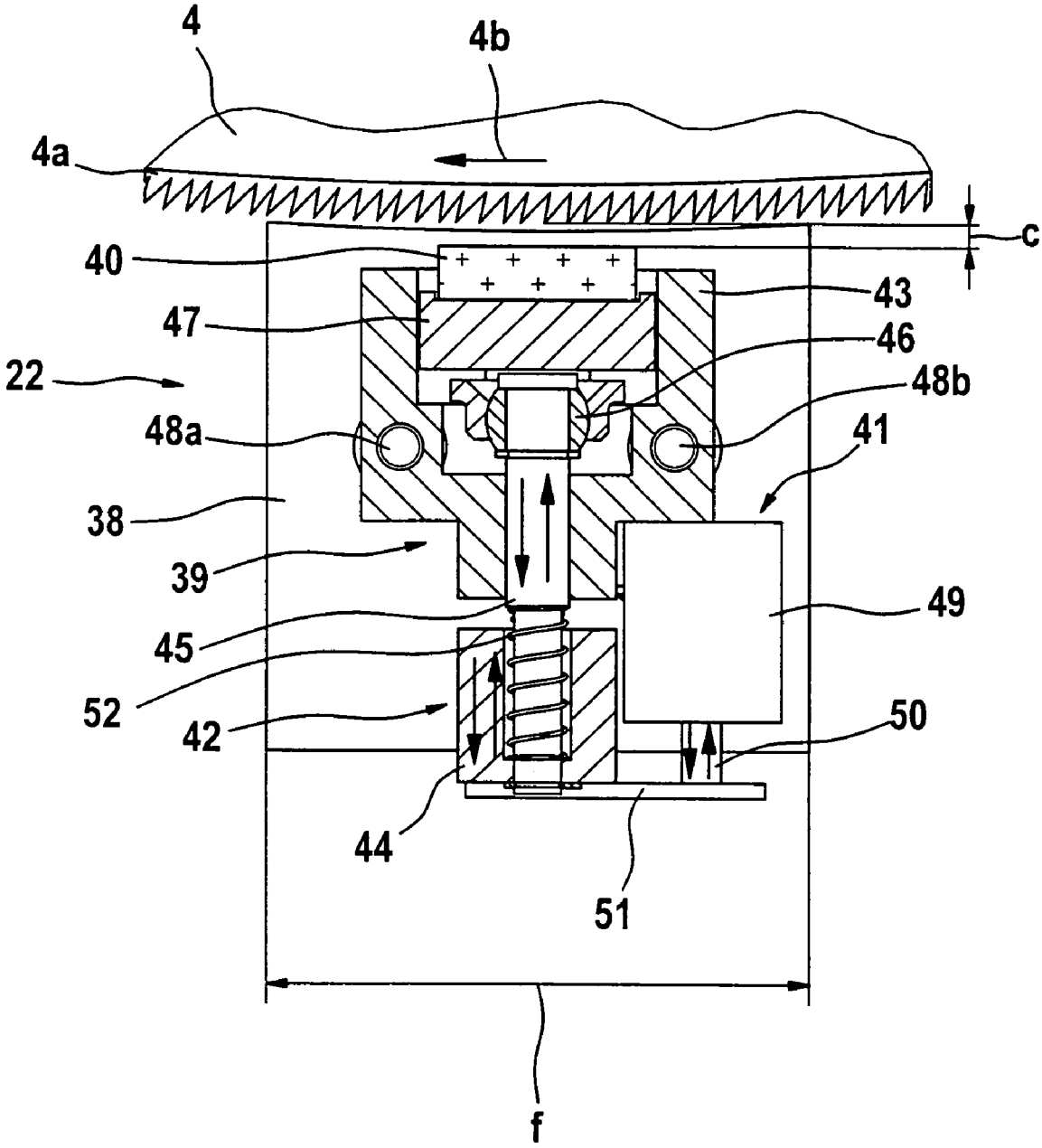
FIGS. 5*a*, 5*b* are, to an enlarged scale, a side view in section (FIG. 5*a*) and a front view in section (FIG. 5*b*) of an embodiment for the grinding of roller clothings, having oscillating (traversing) grinding stones.
Figure 5B:
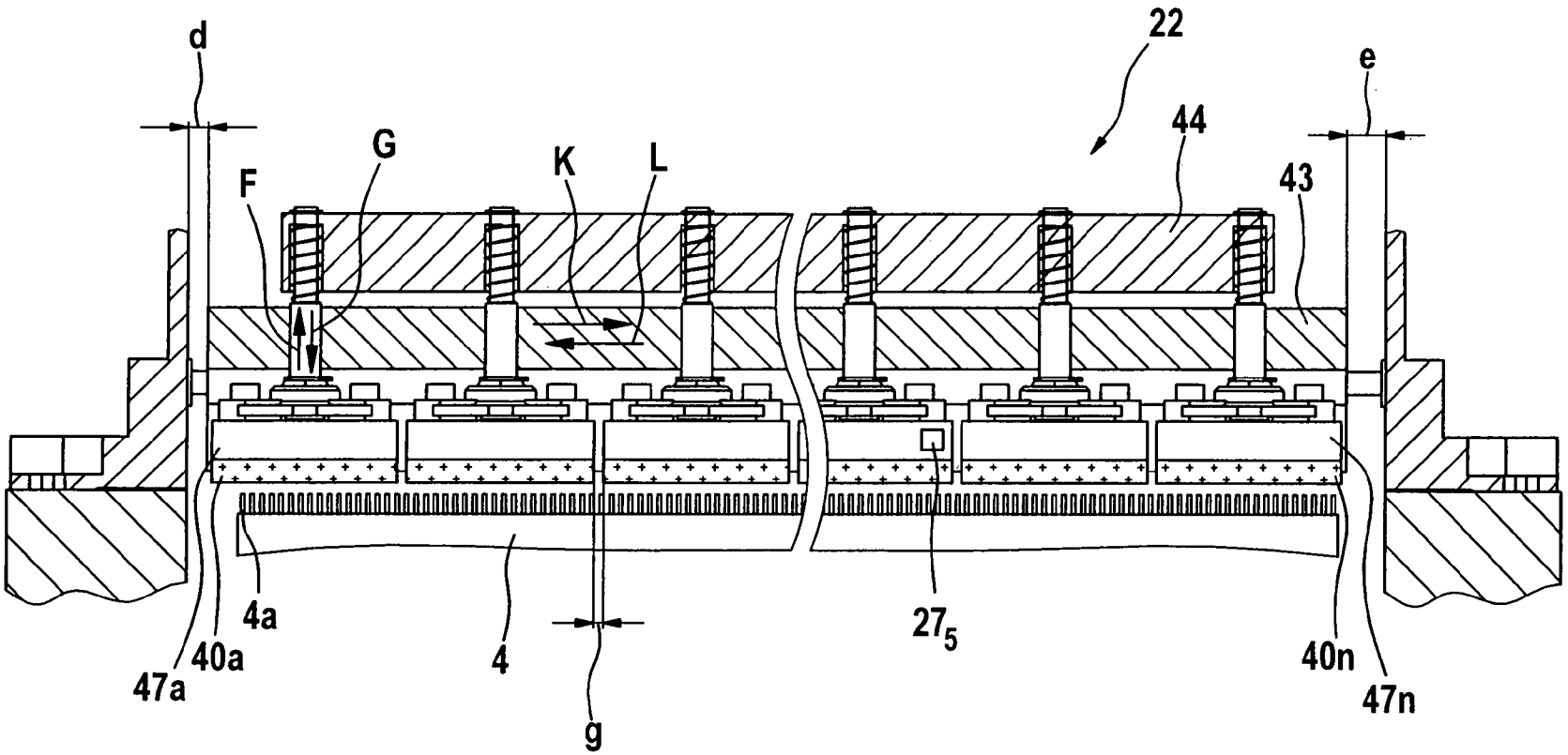
Figure 5C:
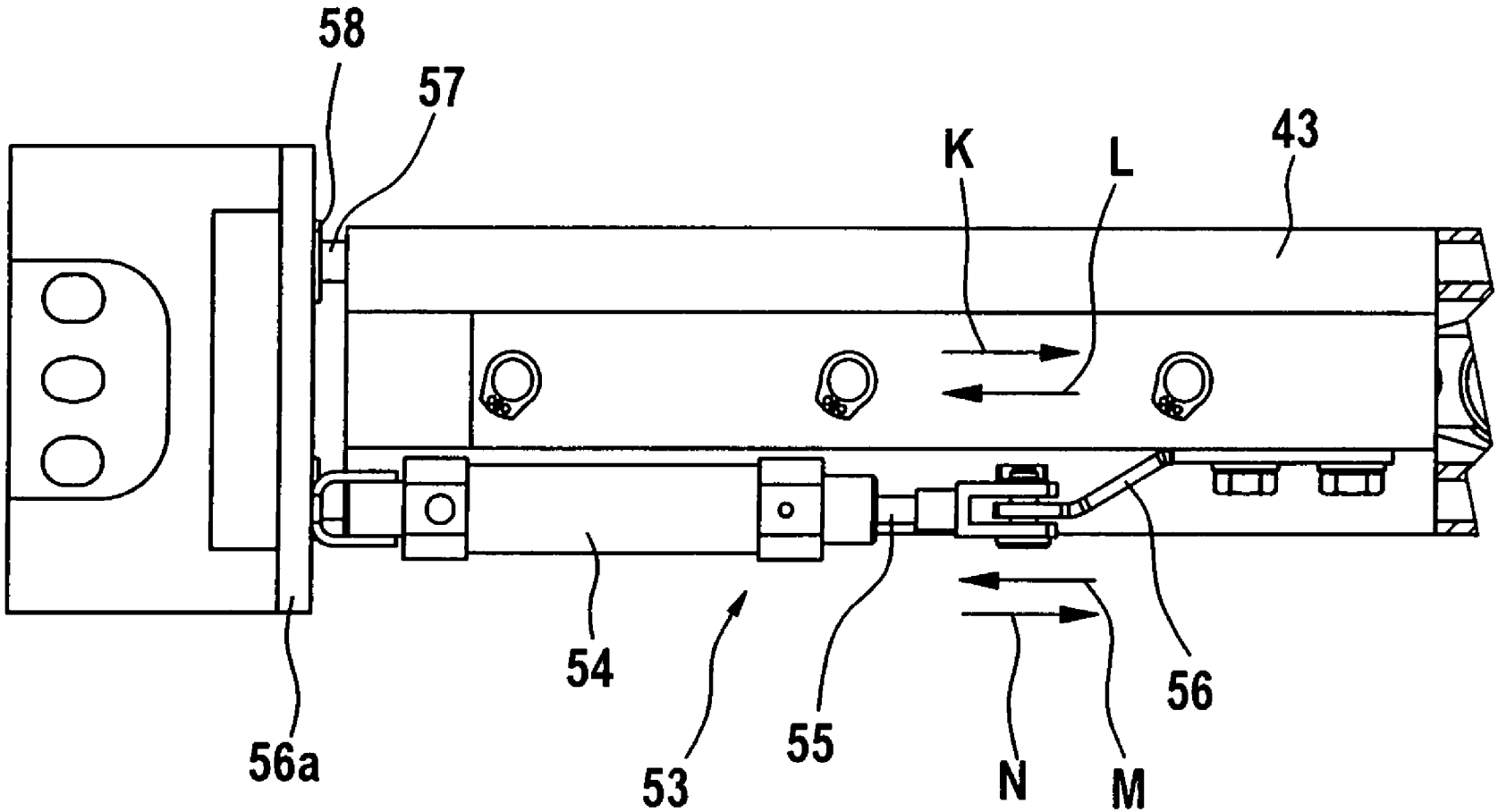
FIG. 5*c* is a partial plan view of the grinding equipment as shown in FIGS. 5*a* and 5*b* with a pneumatically driven displacement device.

FIGS. 5*a*, 5*b* and 5*c* show a further embodiment of grinding apparatus 22 for grinding a clothing on a roller, especially a card cylinder. FIG. 5*a* shows a cylinder 4 fitted with clothing 4*a* and the grinding equipment 22. The grinding equipment 22 comprises a housing 38, in which there are a supporting device 39 with grinding elements 40, an infeed device 41, a biasing device 42 and a displacement device 53 (see FIG. 5*c*). The width of the housing 38 is denoted by the letter f.

The supporting device 39 comprises a guide profile 43 and a support profile 44. A grinding stone carrier 47 with a grinding stone 40 is mounted by means of a universal joint 46 at one end of a guide bolt 45. The guide bolt 45 is mounted so as to move in the direction of the arrows in a continuous bore in the guide profile 42. The other end of the guide bolt 45 projects through a continuous bore in the support profile. A securing ring is attached to the end of the guide bolt 45. The guide profile 43 and the support profile 44 are extruded aluminium profiles. The reference numerals 48*a* and 48*b* denote guide bolts.

The infeed device 41 comprises a pneumatic cylinder 49 with a cylinder rod 50 (piston rod), for example, a pneumatic short stroke cylinder. Mounted at the free end of the cylinder rod 50 is a mechanical driving element 51, for example, a flat plate or the like, which is also secured to the support profile 44. This rigid connection enables the cylinder rod 50 and the support profile 44 to move in each case in the same direction. With its end plate opposite the cylinder rod 50, the cylinder 41 is secured to the guide profile 43, supporting the same. Corresponding to the position of the infeed device 41 illustrated in FIG. 5*a*, a gap c is present between the grinding element 40 and the cylinder clothing 4*a*, i.e. the grinding elements 40 are not in engagement with the cylinder clothing 4*a*. The grinding elements 40*a* to 40*n* are brought into touching contact with the clothing 4*a* by means of the infeed device 41.

The biasing device 42 comprises a helical spring 52, for example, a compression spring, which rests at one end on an edge of the guide bolt 45 and with its other end is supported on a step in the bore of the support profile 44. The biasing device 42 is used to adjust the contact pressure of the grinding elements 40*a* to 40*n* against the clothing 4*a*.

With reference to FIG. 5*b*, a plurality of grinding elements 40*a* to 40*n*, for example, grinding stones, are arranged side by side in a row across the width of the grinding equipment 22 and the cylinder 4 respectively. The gap g between adjacent grinding elements 40*a* to 40*n* amounts to, for example, less than 1.0 mm. The grinding duration is crucial for abrasion of material from the clothing 4*a*. It varies between, for example, 2 and 120 seconds. During the grinding operation, the grinding elements 40*a* to 40*n* perform a traversing or oscillating back and forth movement in the directions K and L.

Upon infeed, (approach towards the clothing 4*a*), the infeed device 41 is moved in the direction of arrow G, and during the reverse movement (lifting away from the clothing 4*a*) the infeed device 41 is moved in the direction of the arrow F. During the movement of the infeed device 41 in directions F and G, the guide profile 43 remains stationary (immobile). During the oscillating grinding movement, both the guide profile 43 and the support profile 44 are moved in the direction of the arrows K and L. The stroke of the back and forth movement amounts to a few millimetres. A structure-borne noise sensor $\mathbf{27}_5$ is mounted on a grinding stone support 47.

Referring to FIG. 5*c*, the displacement device 53 comprises a pneumatic cylinder 54 with cylinder rod 55 (piston rod), for example, a pneumatic short stroke cylinder. At the free end of the piston rod 55 is a mechanical driving element 56, for example, a plate or the like with two offsets, which is also secured to the guide profile 43, for example, by screws. This rigid connection enables the piston rod 55 and the guide profile 43 to be moved in each case in the same direction. With its end plate opposite the cylinder rod 55, the cylinder 54 is secured to a connecting plate 56*a*, supporting the same. The guide profile 43 is in the form of an extruded aluminium profile, with pins 57, for example, steel pins of circular cross-section, adhesively secured in lateral continuous apertures. Pins 57 in the form of guide bolts project from the two end faces of the guide element 43. Sleeves are secured in bores in the connecting plates. The free ends of the guide bolts 48*a*, 48*b* are slidable in the direction of the arrows K and L into the openings of the sleeves. In FIG. 5*b*, different distances d and e are illustrated between the facing end faces of the connecting plates on the one hand and the end faces of the guide profile 43 on the other hand. By means of the displacement device 53, or rather the displacement of the piston rod 55 in the direction of the arrows M and N, the guide profile 43, and at the same time the support profile 44 with it, is caused to oscillate back and forth in the direction of the arrows K and L.

Figure 6:
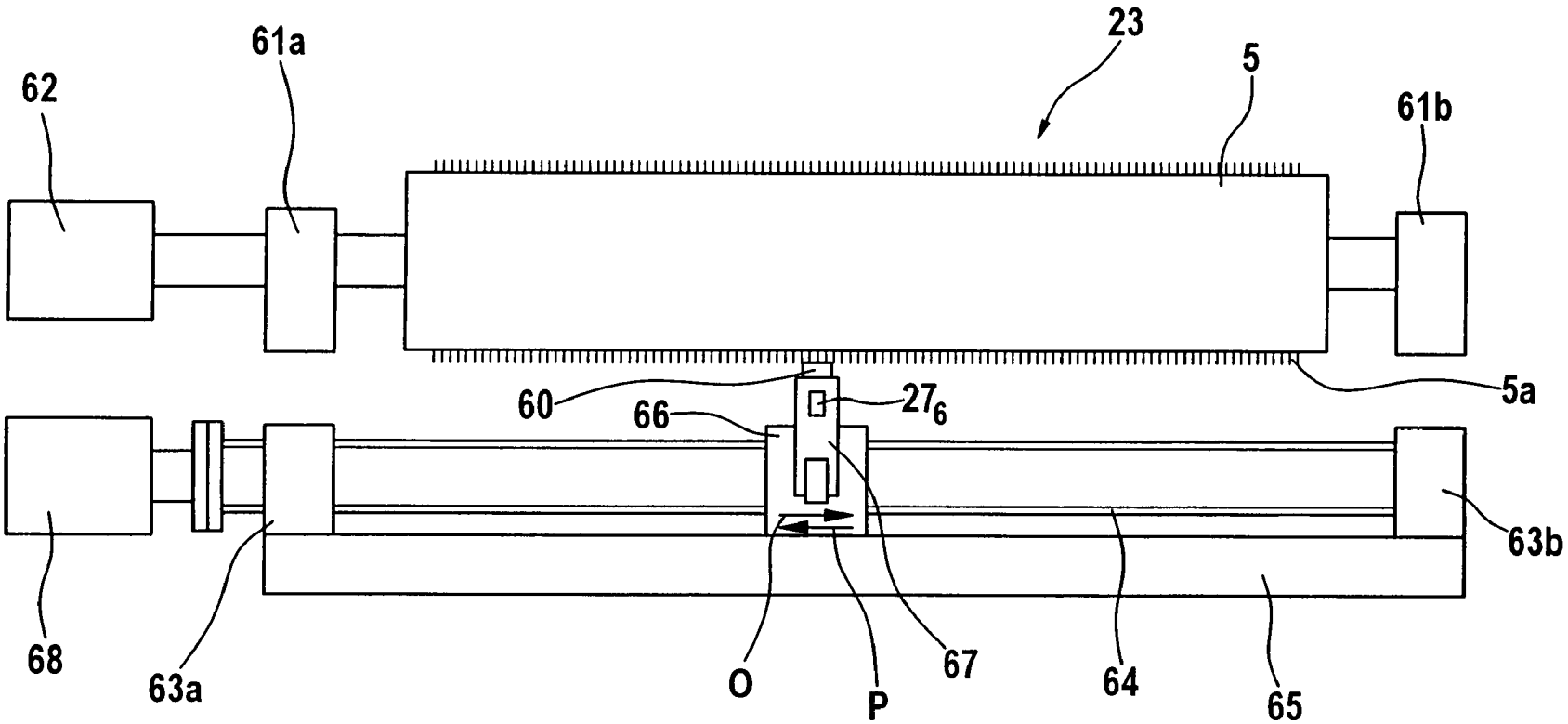
FIG. 6 is a front view of an embodiment for the grinding of roller clothings with a traversing grinding stone.

In a further embodiment shown in FIG. 6, a grinding apparatus 23 has a traversing grinding stone 60 for the grinding of a roller clothing, for example, the clothing 5*a* of the doffer 5, is present. The doffer 5 is mounted in pivot bearings 61*a*, 61*b* to enable it to rotate and be driven. The reference numeral 62 denotes the drive motor for the doffer 5. The spindle bearings 63*a*, 63*b* serve to receive a threaded spindle 64, which moves a sliding element 66 movable in a base plate 65 back and forth along the doffer 5, which is indicated by the arrows O and P, on a grinding stone holder 67. The grinding stone holder 67 is connected by way of a support (not shown) to the sliding element 66 and contains the adjustable grinding stone 60, which can be pushed forwards in a predetermined manner against the clothing 5*a* of the doffer 5. The mechanism for presetting the grinding stone 60 corresponds substantially to the construction shown in FIG. 5*a*.

The spindle 64 is driven by a drive motor 68. A control means for changing the direction of rotation of the drive motor 68 at the end of each movement stroke of the grinding stone 60 is not shown and described here. The drive motors 62 and 68 are each mounted on a stationary bearing plate or the like. A structure-borne noise sensor $\mathbf{27}_6$ is mounted, for example, by adhesion or the like, on the grinding stone holder 67.

Figure 7:
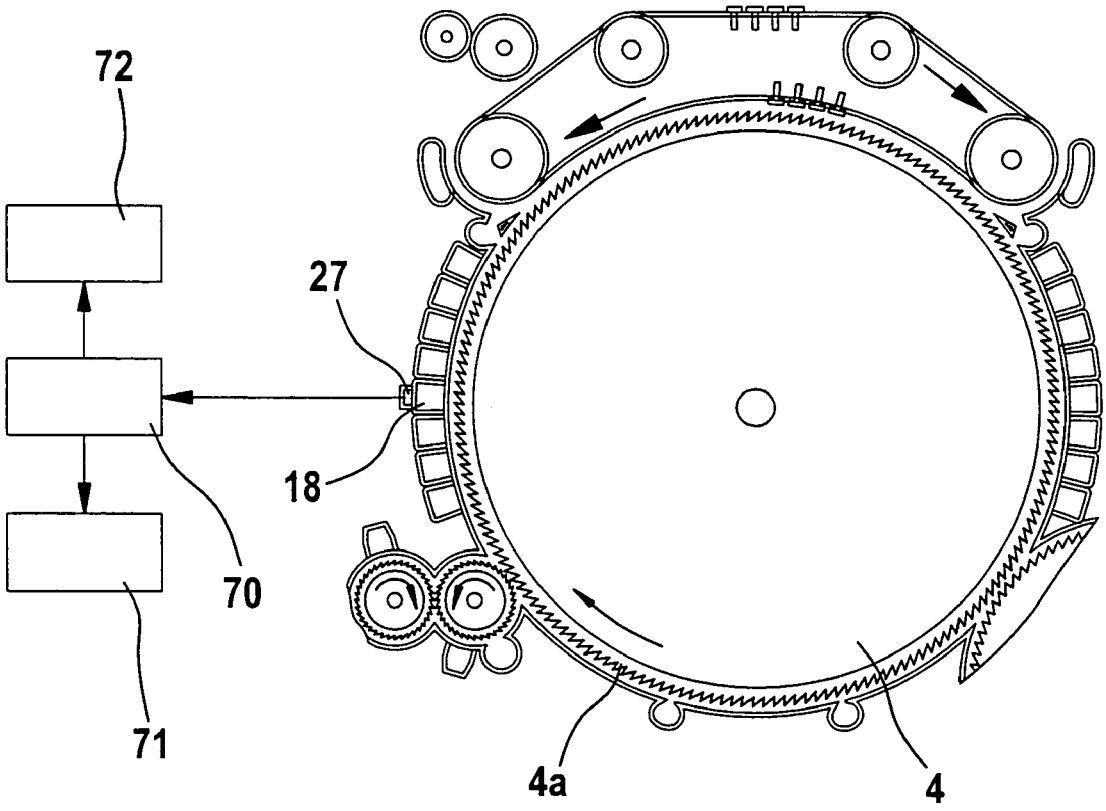
FIG. 7 shows schematically a block diagram with an electronic control and regulating device, to which a structure-borne noise sensor, a filter device, an evaluator, an actuator for a positioning motor, and a display device are connected.

Referring to FIG. 7, which shows the flat card according to FIG. 1, the structure-borne noise sensor 27 mounted on the grinding equipment 18 is connected to an electric control and regulating device 70, for example, a microcomputer with microprocessor. The electric control and regulating device 70 comprises a filter device (not illustrated) and an evaluator (not illustrated). The filter device, for example, a high pass filter, filters out low-frequency vibrations. The evaluator 70, which includes, for example, a frequency analysis function, evaluates the signals of the structure-borne noise sensor 27. From the evaluated signals, the control and regulating device 70 produces input signals for an electric drive motor 71, for example, a variable speed motor, for driving the biasing device 42 (see FIG. 5*a*). In addition, a display device 72 that displays the frequency response, for example, in graph form, is connected to the control and regulating device.

Although the foregoing invention has been described in detail by way of illustration and example for purposes of understanding, it will be obvious that changes and modifications may be practised within the scope of the appended claims.

What we claim is:

1. An apparatus on a carding machine for grinding a fibre processing clothing that is arranged on a rotating roller or a card flat, comprising:

grinding equipment with at least one grinding element;

an infeed device serving to bias the grinding element into contact with the clothing at a contact pressure;

a structure-borne noise sensor associated with the grinding equipment; and an electronic evaluator adapted to control the infeed device to adjust the contact pressure between the grinding element and the clothing based on an intensity level of structure-borne noise detected by the structure-borne noise sensor.

2. An apparatus according to claim 1, in which the structure-borne noise sensor is arranged to emit grinding information in the form of a voltage value, which serves as a measure of the contact pressure, the structure-borne noise sensor having a sensitivity in the range of about 10 V/N to 50 V/N.

3. An apparatus according to claim 1, in which the structure-borne noise sensor is capable of detecting vibrations in the range from about 2.5 kHz to 12.5 kHz.

4. An apparatus according to claim 1, in which the structure-borne noise sensor comprises a piezo-ceramic sensor and is in contact with a component of the grinding equipment.

5. An apparatus according to claim 4, in which the structure-borne noise sensor is fixed to the component by adhesive, by magnetic force, by a screw connection, or with a positive interlocking connection.

6. An apparatus according to claim 1, further comprising a filter device adapted to filter the structure-borne noise sensor signals to remove substantially all components of structure-borne acoustic vibrations of the carding machine that are caused by moving machine parts.

7. An apparatus according to claim 1, in which the evaluator is arranged to use exclusively the components of the structure-borne noise sensor signals that are caused by the grinding operation.

8. An apparatus according to claim 1, in which the evaluator is arranged to evaluate the structure-borne noise sensor signals over time and over a frequency range by means of statistical evaluation methods.

9. An apparatus according to claim 1, in which the evaluator is arranged to logarithmise the structure-borne noise sensor signals to avoid over-valuation of signal peaks.

10. An apparatus according to claim 1, further comprising intensity level classes stored in the electronic unit for evaluating the intensity level of the structure borne noise, the intensity level classes including amplitude and/or frequency classes.

11. An apparatus according to claim 1, in which the electronic evaluator is arranged to evaluate the intensity level of the structure borne noise to determine clothing wear at multiple components of the clothing to adjust the contact pressure between the grinding element and the multiple components of the clothing.

12. An apparatus according to claim 1, in which the structure-borne noise sensor comprises a portable unit adapted to be used on two or more different machines.

13. An apparatus according to claim 1, wherein the structure-borne noise sensor comprises a contactless measuring structure-borne noise sensor associated with a rotating and traversing grinding cylinder.

14. An apparatus according to claim 1, wherein the grinding element comprises a rotating and traversing grinding cylinder, and the structure-borne noise sensor is fixed in position on the grinding equipment, further comprising leaf springs configured to conduct structure borne noise from the rotating and traversing grinding cylinder to the structure-borne noise sensor.

15. An apparatus according to claim 1, in which the evaluator holds a working range for the optimum grinding intensity.

16. An apparatus according to claim 1, wherein the evaluator is adapted to control the infeed device to bias the grinding element into contact with the clothing in a closed loop fashion in dependence on the structure-borne noise sensor signal.

17. An apparatus according to claim 1, in which the evaluator is adapted to ascertain the contact pressure for each of a multiplicity of flats, and after completion of grinding the evaluator is adapted to display a distribution of the contact pressure.

18. An apparatus according to claim 17, wherein the evaluator is adapted to ascertain the contact pressure for each flat, and decrease the contact pressure for each flat after each revolution.

19. An apparatus according to claim 18, wherein the evaluator is adapted to automatically graduate the contact pressure.

20. An apparatus according to claim 18, further comprising a controller storing a predetermined grinding profile across a width of each respective flat.

21. An apparatus according to claim 20, wherein the controller is adapted to issue a warning indicating departure from the predetermined grinding profile.

22. An apparatus according to claim 4, wherein the structure-borne noise sensor is adapted to detect signal frequencies and amplitudes of the grinding equipment that occur with no grinding operation, and the filter device is adapted to filter out of the detected signal frequencies and amplitudes during grinding by means of signal band filtering or cross correlation.

23. An apparatus according to claim 1, further comprising a revolving card flat, a stationary flat, a roller of a flat card, or a roller of a roller card, wherein the clothing is disposed on the revolving card flat, the stationary flat, the roller of a flat card, or the roller of a roller card.

24. An apparatus according to claim 1, in which the grinding element comprises a full grinding cylinder.

25. An apparatus according to claim 1, in which the grinding element comprises a traversing grinding wheel, a traversing grinding stone, or an oscillating grinding stone.

* * * * *